US010969725B2

(12) United States Patent
Saito

(10) Patent No.: US 10,969,725 B2
(45) Date of Patent: Apr. 6, 2021

(54) IMAGE FORMING SYSTEM, SHEET PROCESSING DEVICE, AND CONTROL METHOD OF SHEET PROCESSING DEVICE

(71) Applicant: TOSHIBA TEC KABUSHIKI KAISHA, Tokyo (JP)

(72) Inventor: Yuichi Saito, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 256 days.

(21) Appl. No.: 16/283,957

(22) Filed: Feb. 25, 2019

(65) Prior Publication Data

US 2020/0272083 A1 Aug. 27, 2020

(51) Int. Cl.
*G03G 15/00* (2006.01)

(52) U.S. Cl.
CPC ..... *G03G 15/6541* (2013.01); *G03G 15/5029* (2013.01)

(58) Field of Classification Search
CPC ..... G03G 15/6541; G03G 2215/00417
See application file for complete search history.

(56) References Cited

U.S. PATENT DOCUMENTS 4,421,246 A * 12/1983 Schultz ..... G01N 1/36 206/205
6,216,935 B1 * 4/2001 Oussani, Jr. ..... B25C 5/0228 227/131
6,948,224 B2 * 9/2005 Coombs ..... G03G 15/6544 227/5
8,495,821 B2 * 7/2013 Wang ..... B65H 7/02 33/549
2004/0232610 A1 * 11/2004 Saito ..... B42C 1/12 270/58.09
2009/0190986 A1 * 7/2009 Miyazaki ..... G03G 15/6573 399/407
2015/0102548 A1 * 4/2015 Balili ..... B65H 39/00 270/58.09
2020/0233360 A1 * 7/2020 Yamamoto ..... G03G 15/55

FOREIGN PATENT DOCUMENTS

JP 05-8580 1/1993

* cited by examiner

*Primary Examiner* — Jennifer E Simmons
(74) *Attorney, Agent, or Firm* — Amin, Turocy & Watson LLP

(57) ABSTRACT

According to one embodiment, a sheet processing device includes a stapler, a process tray, a first sensor, a second sensor, and a control unit. The stapler performs stapling on the sheet. The process tray places the sheet to be stapled on the upper surface. The first sensor is disposed on the upper side of the process tray. The first sensor outputs a first signal corresponding to a first distance to an object which is disposed at a first position of the process tray. The second sensor is disposed on the upper side of the process tray. The second sensor outputs a second signal corresponding to a second distance to the object which is disposed at a second position on the downstream side in a sheet discharge direction from the first position of the process tray. The control unit controls the stapling using the first signal and the second signal.

20 Claims, 9 Drawing Sheets

IMAGE FORMING SYSTEM, SHEET PROCESSING DEVICE, AND CONTROL METHOD OF SHEET PROCESSING DEVICE

FIELD

Embodiments described herein relate generally to an image forming system, a sheet processing device, and a control method of the sheet processing device.

BACKGROUND

A sheet processing device is used to staple a sheet which is conveyed from an image forming device. The sheet processing device performs the stapling on the sheet which is placed in a process tray. The sheet processing device discharges the stapled sheet from a sheet discharging port.

When a foreign matter permeates the process tray from the sheet discharging port, the foreign matter may be stapled. There is a need for a sheet processing device which can avoid stapling a foreign matter.

DETAILED DESCRIPTION

In general, according to one embodiment, an image forming system includes an image forming device, a stapler, a process tray, a first sensor, a second sensor, and a control unit. The image forming device forms an image on a sheet. The stapler performs stapling on the sheet. The process tray places the sheet to be stapled on the upper surface. The first sensor is disposed on the upper side of the process tray. The first sensor outputs a first signal corresponding to a first distance to an object which is disposed at a first position of a sheet placement region of the upper surface of the process tray or a first thickness of the object which is disposed at the first position. The second sensor is disposed on the upper side of the process tray. The second sensor outputs a second signal corresponding to a second distance to the object which is disposed at a second position on the downstream side in a sheet discharge direction from the first position of the sheet placement region of the upper surface of the process tray or a second thickness of the object which is disposed at the second position. The control unit is provided in the image forming device. The control unit controls the stapling using the first signal and the second signal.

Hereinafter, the image forming system, a sheet processing device, and the control method of the sheet processing device of the embodiment will be described with reference to the drawings.

In this disclosure, an X direction, a Y direction, and a Z direction of an orthogonal coordinate system are defined as follows. The X direction and the Y direction are directions parallel to the upper surface of the process tray. The X direction is a direction of discharging the sheet placed in the process tray, and a +X direction indicates the downstream side in the discharge direction. The Y direction is a width direction of the sheet placed in the process tray, and is a direction perpendicular to the X direction. The Z direction is a normal direction of the upper surface of the process tray, and the +Z direction is a direction of placing a sheet with respect to the upper surface of the process tray.

The image forming system will be described.

Figure 1:
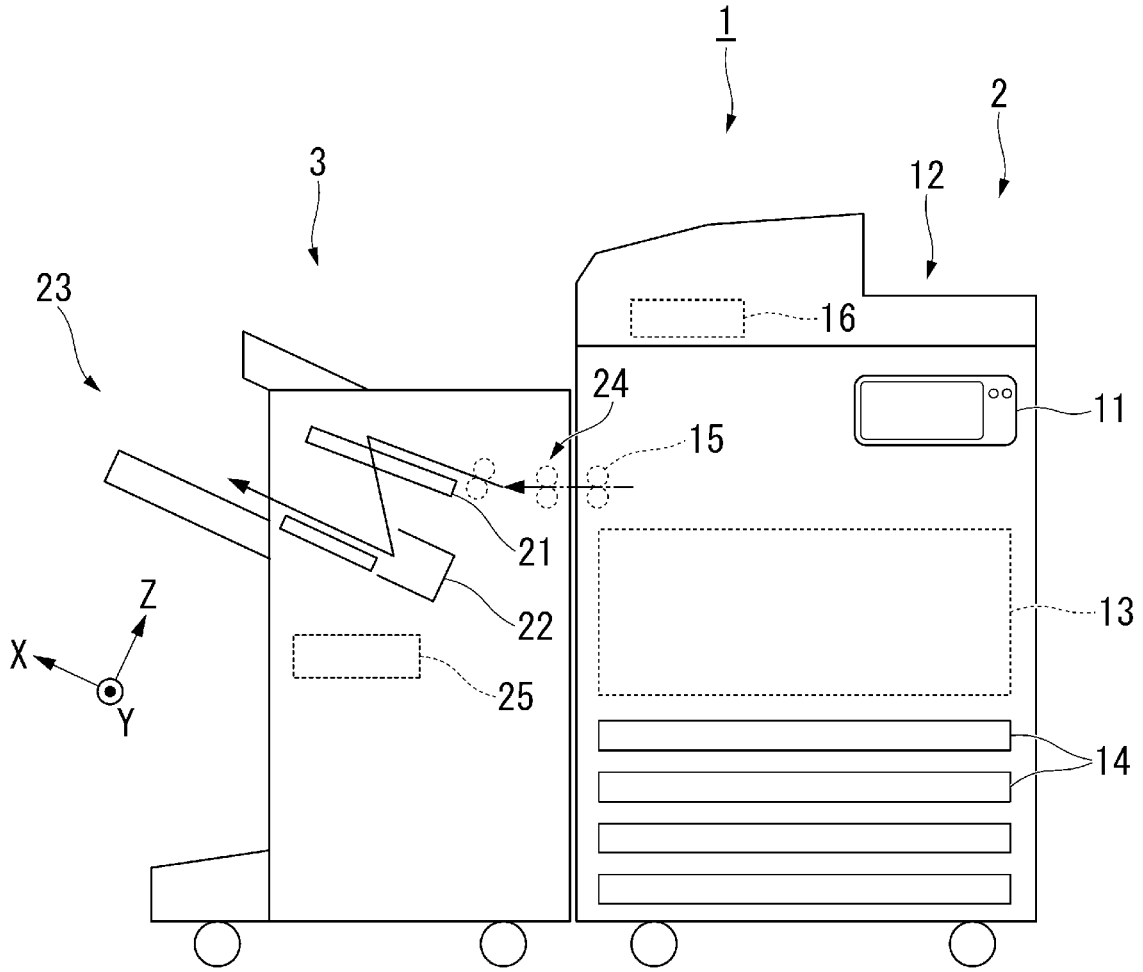
FIG. 1 is a diagram schematically illustrating an example of the entire configuration of an image forming system of an embodiment.
Figure 2:
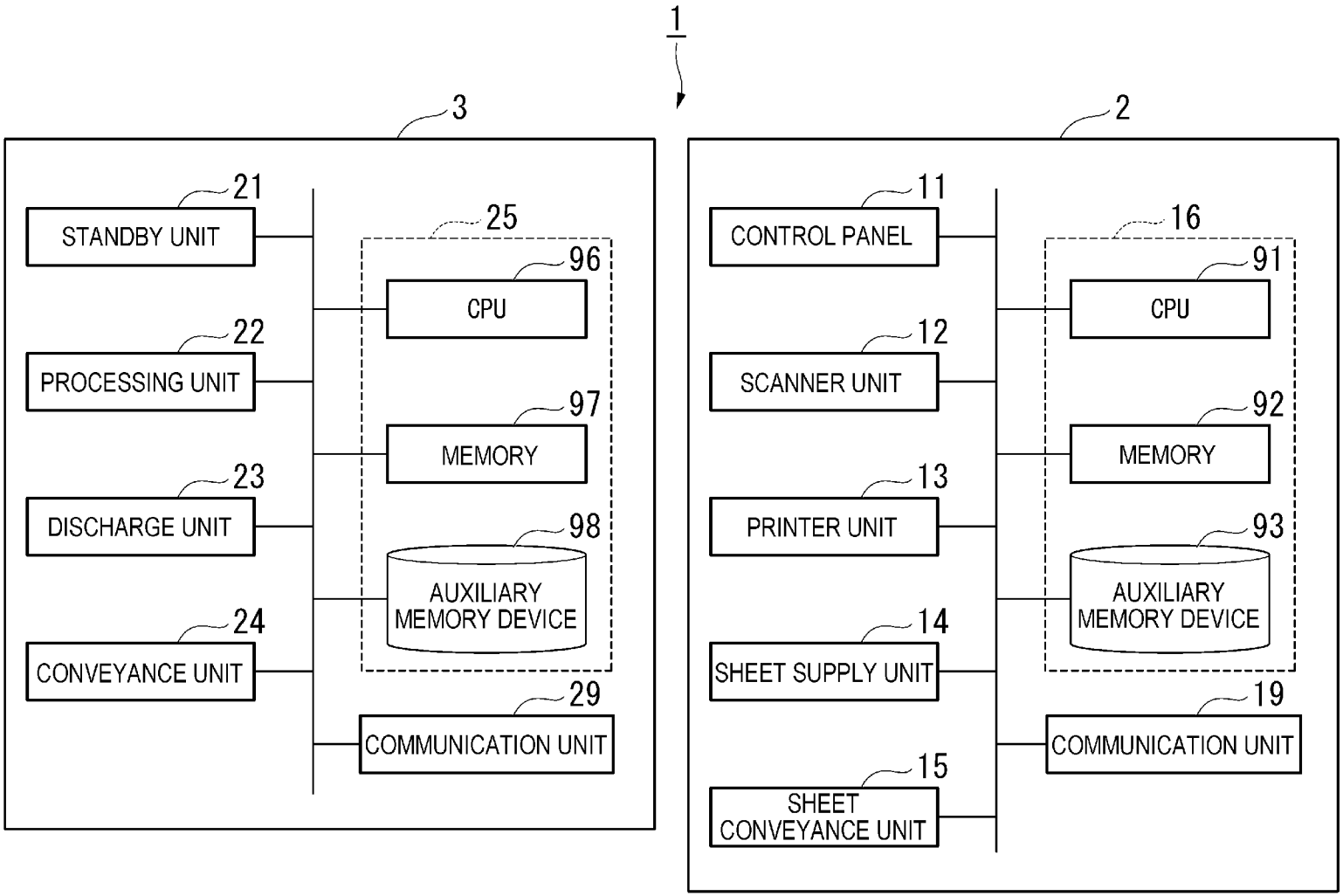
FIG. 2 is a block diagram illustrating an example of the functional configurations of an image forming device and a sheet processing device of the embodiment.

FIG. 1 is a diagram schematically illustrating an example of the entire configuration of the image forming system of the embodiment. FIG. 2 is a block diagram illustrating an exemplary configuration of the image forming device and the sheet processing device of the embodiment.

As illustrated in FIG. 1, an image forming system 1 includes an image forming device 2 and a sheet processing device 3. The image forming device 2 forms an image on a recording medium (referred to as a sheet S) of a sheet shape such as a paper sheet. The sheet processing device 3 performs a post processing on the sheet S which is discharged from the image forming device 2.

The image forming device 2 includes a control panel 11, a scanner unit 12, a printer unit 13, a sheet supply unit 14, a sheet conveyance unit 15, and an image forming control unit (control unit) 16.

The control panel 11 includes an operation unit and a display unit. The operation unit receives a user's operation. For example, the operation unit includes various types of keys and a touch panel. The display unit displays various types of information.

The control panel 11 receives an input related to the selection of a staple mode. The staple mode is a processing mode in which binding (stapling) is performed using a staple. The control panel 11 may receive an input related to the size of the sheet S to be stapled if the selection of the staple mode is received. The control panel 11 may receive an input related to the number of the sheets S to be stapled if the selection of the staple mode is received. The image forming control unit 16 described below transmits information related to the post processing received by the control panel 11 to a post-processing control unit 25.

The scanner unit 12 reads image information of a copy object as brightness and darkness of light.

The printer unit 13 forms an output image (hereinafter, referred to as "toner image") by a developer such as a toner on the basis of the image information which is received from the scanner unit 12 or an external device. The printer unit 13 transfers the toner image to the surface of the sheet S. The printer unit 13 heats and presses the toner image of the surface of the sheet S to fix the toner image to the sheet S. The printer unit 13 sends the sheet S with the toner image fixed thereto to the sheet conveyance unit 15.

The sheet supply unit 14 supplies the sheet S one by one to the printer unit 13 in synchronization with the timing when the printer unit 13 forms the toner image. The sheet supply unit 14 includes a plurality of sheet cassettes. The plurality of sheet cassettes store the sheets S of the size and type which are set in advance. The sheet cassette includes a pickup roller. The pickup roller takes out the sheet S one by one from the sheet cassette and sends the sheet to the printer unit 13.

The sheet conveyance unit 15 conveys the sheet S received from the printer unit 13 to the sheet processing device 3.

As illustrated in FIG. 2, the image forming device 2 includes a central processing unit (CPU) 91, a memory 92, and an auxiliary memory device 93 which are connected through a bus, and executes a program. When executing the program, the image forming device 2 serves as a device which includes the control panel 11, the scanner unit 12, the printer unit 13, the sheet supply unit 14, the sheet conveyance unit 15, and a communication unit 19.

The CPU 91 serves as the image forming control unit (control unit) 16 when the program stored in the memory 92 and the auxiliary memory device 93 is executed. The image forming control unit 16 controls various types of operations of the units of the image forming device 2 and the sheet processing device 3.

The auxiliary memory device 93 includes a storage device such as a magnetic hard disk device and a semiconductor memory device. The auxiliary memory device 93 stores information.

The communication unit 19 is configured to include a communication interface to be connected to an external device. The communication unit 19 communicates with an external device through the communication interface.

The sheet processing device 3 will be described.

Figure 3:
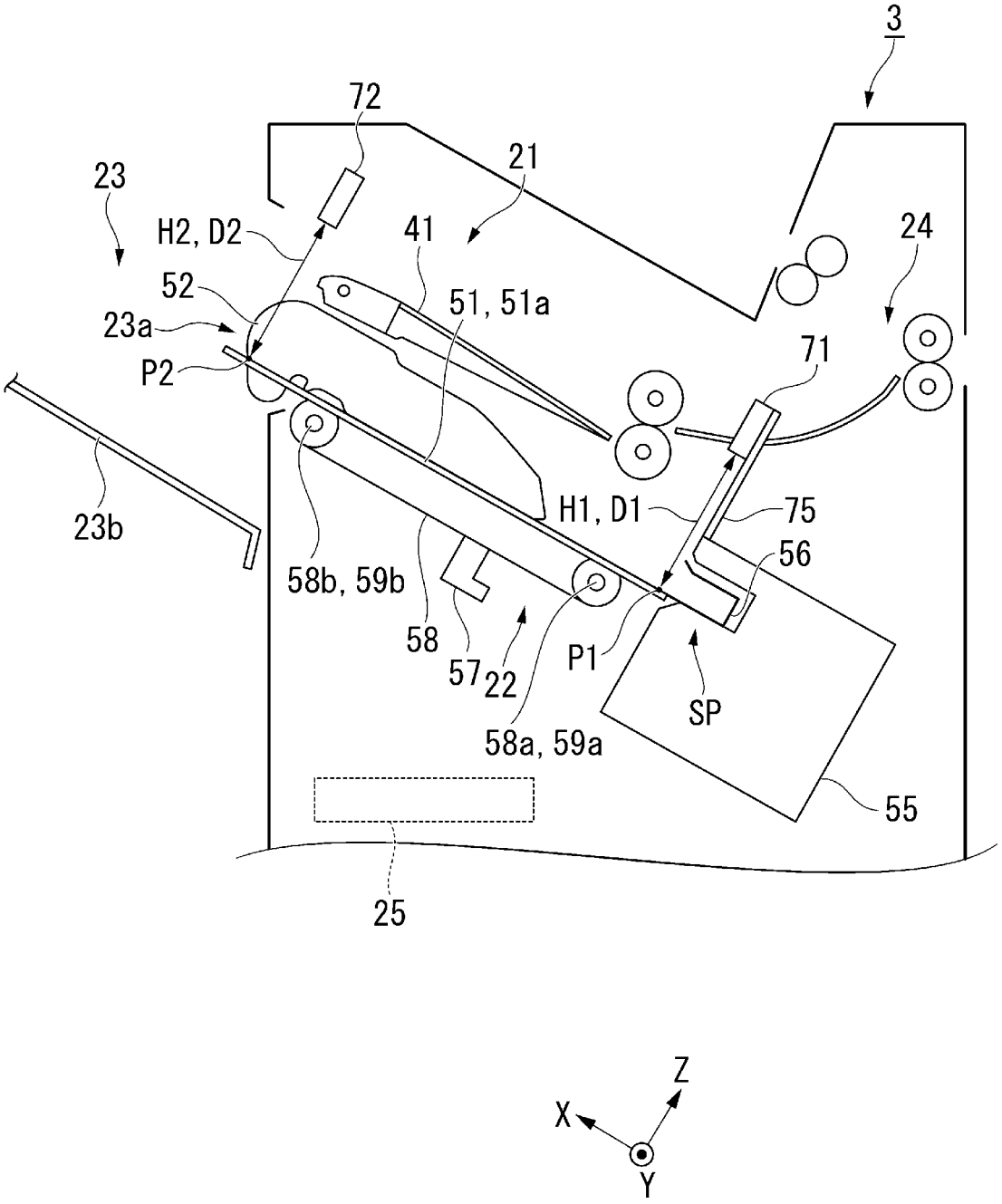
FIG. 3 is a side view schematically illustrating an exemplary configuration of the sheet processing device of the embodiment.
Figure 4:
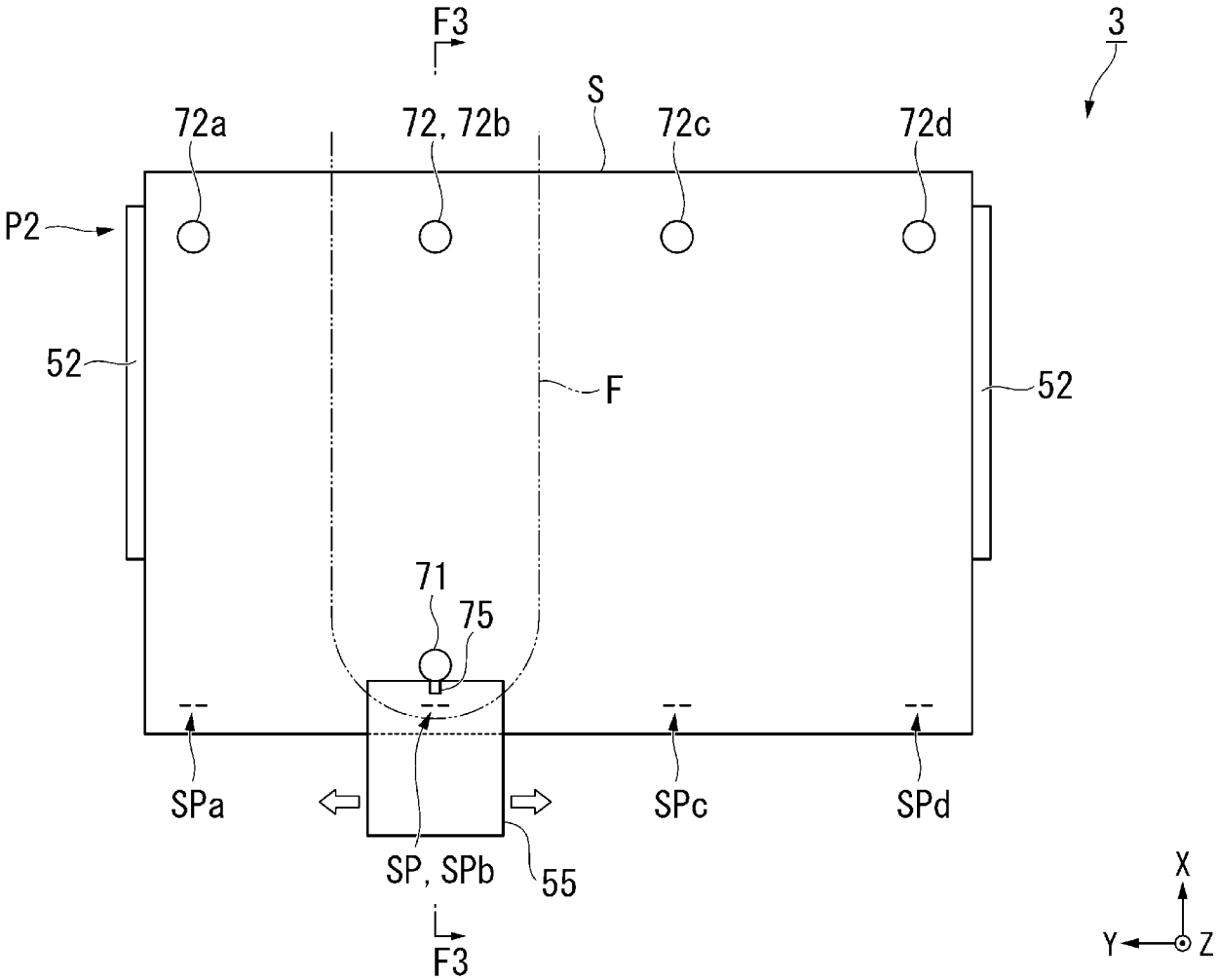
FIG. 4 is a top view schematically illustrating an exemplary configuration of the sheet processing device of the embodiment.

FIG. 3 is a side view schematically illustrating an exemplary configuration of the sheet processing device 3 of the embodiment. FIG. 4 is a top view schematically illustrating an exemplary configuration of the sheet processing device of the embodiment. FIG. 3 is a cross-sectional view taken along line F3-F3 of FIG. 4. As illustrated in FIG. 3, the sheet processing device 3 includes a standby unit 21, a processing unit 22, a discharge unit 23, a conveyance unit 24, and the post-processing control unit 25.

The conveyance unit 24 supplies the sheet S supplied from the image forming device 2 to the standby unit 21.

The standby unit 21 includes a standby tray 41. The standby tray 41 includes a pair of tray members. The pair of tray members moves in an opposite direction to each other along the Y direction. The pair of tray members approaches to each other and supports the sheet S to the upper surface if the sheet S is set in standby in the standby tray 41. The pair of tray members moves in a direction away from each other if the sheet S falls down from the standby tray 41 toward the processing unit 22 to release the supporting of the sheet S.

The processing unit 22 includes a process tray 51, a pair of horizontal alignment plates 52, a stapler 55, an ejector 56, a bundle pawl 57, and conveyance rollers 59*a* and 59*b*.

The process tray 51 is formed in a plate shape. The process tray 51 is disposed in the −Z direction of the standby tray 41 in parallel to the standby tray 41. The upper surface of the process tray 51 is inclined to the lower direction from the +X side to the −X side.

The pair of horizontal alignment plates 52 moves in the opposite direction to each other along the Y direction. The pair of horizontal alignment plates 52 approaches each other to pinch the sheet S from both sides in the Y direction so as to horizontally align the sheet S in the Y direction. The pair of horizontal alignment plates 52 moves in a direction away from each other when discharging the sheet S from the process tray 51.

The stapler 55 is disposed in a −X direction of the process tray 51. The stapler 55 performs the stapling (binding) to a bundle of the plurality of the sheets S.

As illustrated in FIG. 4, the stapler 55 is formed to be movable in the Y direction. A staple position SP in the Y direction if the stapling is performed on the sheet S is set in advance according to the size of the sheet S. In the example of FIG. 4, the staple position if the stapling is performed on the center portion of the sheet S is set to B position SPb and C position SPc. The staple position if the stapling is performed on the end of the sheet S is set to A position Spa or D position SPd. The stapler 55 is movable to A position SPa, B position SPb, C position SPc, and D position SPd along the Y direction.

The ejector 56 is formed in a hook shape when viewed from the Y direction as illustrated in FIG. 3. The ejector 56 is disposed in the −X direction of the process tray 51. The ejector 56 supports the end in the −X direction of the sheet S which is placed in the process tray 51. The ejector 56 moves the sheet S to a position to deliver the sheets to the bundle pawl 57 in +X direction when the sheet S is discharged from the process tray 51.

The bundle pawl 57 presses and moves the sheet S of the process tray 51 in the +X direction. The bundle pawl 57 is formed in a hook shape when viewed from the Y direction. The bundle pawl 57 is fixed to a bundle pawl belt 58. The bundle pawl belt 58 is suspended on a pair of belt rollers 58*a* and 58*b* which are separately disposed in the X direction. The bundle pawl 57 moves from the lower surface side to the upper surface side of the process tray 51 as the bundle pawl belt 58 rotates. The bundle pawl 57 receives the sheet S from the ejector 56 in the upper surface side of the process tray 51. The bundle pawl 57 presses the sheet S in the +X direction, and discharges the sheet from a sheet discharging port 23*a*.

The first conveyance roller 59*a* is disposed to overlap the first belt roller 58*a* when viewed from the Y direction. The second conveyance roller 59*b* is disposed to be overlapped with the second belt roller 58*b* when viewed from the Y direction.

The conveyance rollers 59*a* and 59*b* serve as vertical alignment rollers. The conveyance rollers 59*a* and 59*b* rotate in a clockwise direction in FIG. 3 to convey the sheet S placed in the process tray 51 toward the ejector 56. The conveyance rollers 59*a* and 59*b* align the position of the end of the sheet S in the −X direction, which is placed in the process tray 51.

The conveyance rollers 59*a* and 59*b* convey the sheet S in the +X direction by rotating in a counterclockwise direction in FIG. 3. The conveyance rollers 59*a* and 59*b* convey the sheet S placed in the process tray 51 toward the discharge unit 23.

The discharge unit 23 includes the sheet discharging port 23*a* and a movable tray 23*b*. The sheet discharging port 23*a* is formed in the +X direction of the process tray 51. The movable tray 23*b* is disposed on the lower side in the vertical direction of the outside of the sheet discharging port 23*a*. The sheet S discharged from the sheet discharging port 23*a* is placed on the upper surface of the movable tray 23*b*. The movable tray 23*b* is movable in the upward and downward direction according to the amount of placed sheets S.

As illustrated in FIG. 2, the sheet processing device 3 includes a central processing unit (CPU) 96, a memory 97, and an auxiliary memory device 98 which are connected by a bus, and executes a program. When executing the program, the sheet processing device 3 serves as a device which includes the standby unit 21, the processing unit 22, the discharge unit 23, the conveyance unit 24, and a communication unit 29.

The CPU 96 serves as the post-processing control unit 25 by performing the program stored in the memory 97 and the auxiliary memory device 98. The post-processing control unit 25 controls the operations of the units of the sheet processing device 3.

The auxiliary memory device 98 includes a storage device such as a magnetic hard disk device or a semiconductor memory device. The auxiliary memory device 98 stores information.

The communication unit 29 is configured to include a communication interface to be connected to an external device. The communication unit 29 communicates with an external device through the communication interface.

A first sensor 71 and a second sensor 72 will be described.

As illustrated in FIG. 3, the processing unit 22 of the sheet processing device 3 includes the first sensor 71 and the second sensor 72. The sensors 71 and 72 are sensors of a non-contact type. The sensors 71 and 72 are distance sensors which output a signal corresponding to a distance to the object. For example, as a distance sensor of the non-contact type, a laser sensor or an ultrasonic sensor may be used. The sensors 71 and 72 may be thickness sensors which output a signal corresponding to a thickness of the object. As an example of the thickness sensor of the non-contact type, an electrostatic capacity sensor may be used.

The first sensor 71 outputs a first signal corresponding to a first distance D1 from the first sensor 71 to the object which is disposed at a first position P1 of a sheet placement region 51*a* of the upper surface of the process tray 51. The first sensor 71 is disposed on the upper side in the vertical direction of the first position P1 with respect to the upper surface of the process tray 51.

The sheet placement region 51*a* is a region where the sheet S to be stapled is always placed on the upper surface of the process tray 51. Various sizes of the sheets S are placed on the upper surface of the process tray 51. In the sheet placement region 51*a*, the sheet S to be stapled is always placed regardless of the size of the sheet S. In other words, the sheet S is placed always in the sheet placement region 51*a* even if the smallest size of the sheet S is supplied in the X direction and the Y direction.

The first position P1 is a position in the +X direction of the stapler 55, and near the stapler 55. A height H1 is a height from the upper surface of the process tray 51 to the first sensor 71. The first distance D1 is matched with the height H1 when the object is not disposed at the first position P1. The first signal is an electrical signal.

The second sensor 72 outputs the second signal corresponding to a second distance D2 from the second sensor 72 to the object which is disposed at a second position P2 of the sheet placement region 51*a* of the upper surface of the process tray 51. The second sensor 72 is disposed on the upper side in the vertical direction of the second position P2 with respect to the upper surface of the process tray 51.

The second position P2 is a position in the +X direction of the first position P1, and near the sheet discharging port 23*a*. A height H2 is a height from the upper surface of the process tray 51 to the second sensor 72. The second distance D2 is matched with the height H2 when the object is not disposed at the second position P2. The second signal is an electrical signal.

The first sensor 71 and the second sensor 72 are disposed to almost the same height from the upper surface of the process tray 51. In other words, the height H1 and the height H2 are almost the same.

The first sensor 71 is coupled to the stapler 55 through a first coupling member 75. As illustrated in FIG. 4, the first sensor 71 is disposed at the same position as the stapler 55 in the Y direction. With this configuration, the first sensor 71 is movable to A position SPa, B position SPb, C position SPc, and D position SPd along the Y direction together with the stapler 55.

The second sensor 72 is configured by a plurality of second distribution sensors 72*a*, 72*b*, 72*c*, and 72*d*. The plurality of second distribution sensors 72*a*, 72*b*, 72*c*, and 72*d* are disposed at the second position P2 in the X direction. The plurality of second distribution sensors 72*a*, 72*b*, 72*c*, and 72*d* are disposed in correspondence with a plurality of staple positions SPa, SPb, SPc, and SPd in the Y direction. In other words, the second A distribution sensor 72*a* is disposed at A position SPa in the Y direction. The second B distribution sensor 72*b* is disposed at B position SPb in the Y direction. The second C distribution sensor 72*c* is disposed at C position SPc in the Y direction. The second D distribution sensor 72*d* is disposed at D position SPd in the Y direction.

Figure 5:
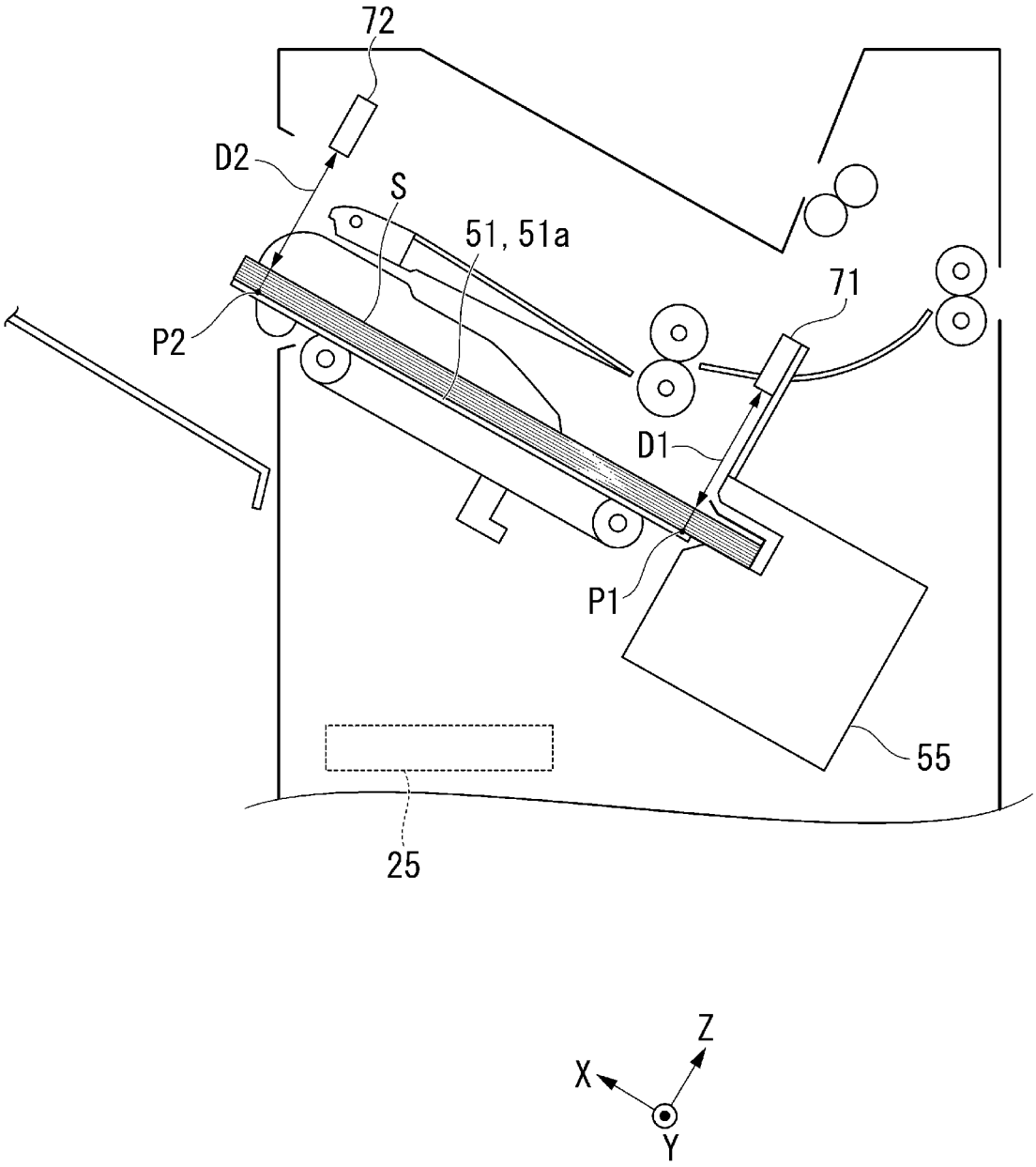
FIG. 5 is a diagram for describing an operation if a sheet is disposed in a process tray.

FIG. 5 is a diagram for describing an operation if the sheet is disposed in the process tray. In a normal stapling, a plurality of sheets S are overlapped and placed in the process tray 51. The sheet S is placed to cover the entire sheet placement region 51*a* of the upper surface of the process tray 51. The first position P1 and the second position P2 are positioned inside the sheet placement region 51*a*.

The first sensor 71 outputs the first signal corresponding to the first distance D1 to the object which is disposed at the first position P1. The object disposed at the first position P1 is the plurality of the sheets S. The first distance D1 is a distance from the first sensor 71 to the sheet S of the uppermost layer among the plurality of the sheets S. The first sensor 71 outputs the first signal corresponding to the first distance D1 to the image forming control unit 16.

The second sensor 72 outputs the second signal corresponding to the second distance D2 to the object which is disposed at the second position P2. The object disposed at the second position P2 is the plurality of the sheets S. The second distance D2 is a distance from the second sensor 72 to the sheet S of the uppermost layer among the plurality of the sheets S. The second sensor 72 outputs the second signal corresponding to the second distance D2 to the image forming control unit 16.

The image forming control unit 16 controls the stapling using the first signal and the second signal. The image forming control unit 16 calculates the first distance D1 from the first signal, calculates the second distance D2 from the second signal, and compares the first distance D1 and the second distance D2. As described above, the first sensor 71 and the second sensor 72 are disposed at the same height from the upper surface of the process tray 51. At the first position P1 and the second position P2, the thickness in the Z direction of the plurality of the sheets S is equal. Therefore, the first distance D1 and the second distance D2 are equal if the sheet S is disposed in the process tray 51. The image forming control unit 16 determines that the sheet S is disposed in the process tray 51 if the first distance D1 and the second distance D2 are equal. Specifically, the image forming control unit 16 determines that the sheet S is disposed in the process tray 51 if the difference between the first distance D1 and the second distance D2 is less than a predetermined value. At this time, the image forming control unit 16 performs the stapling. Specifically, the image forming control unit 16 outputs an execution signal of the stapling to the stapler 55. With this configuration, the stapling is performed on the sheet S.

Figure 6:
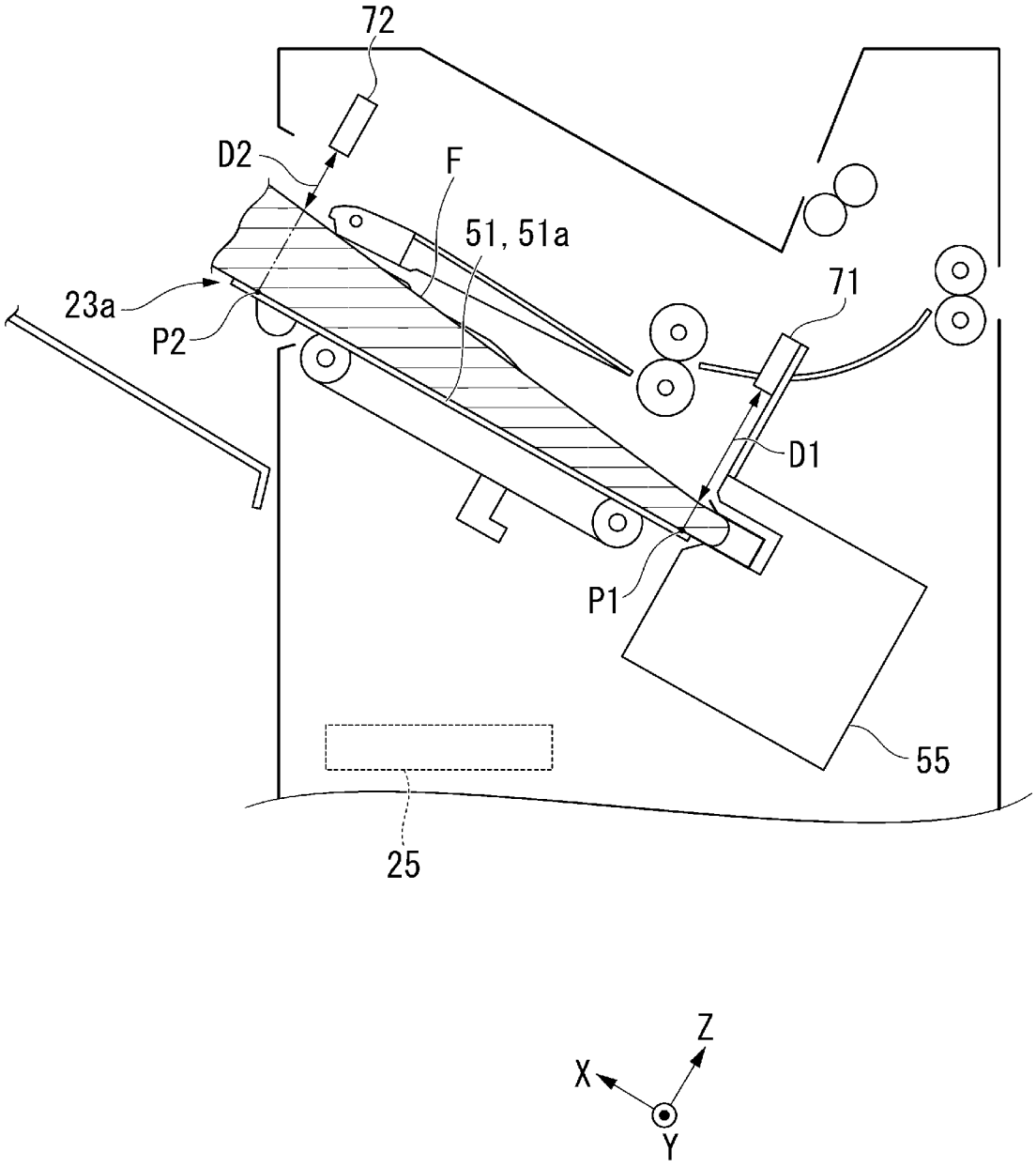
FIG. 6 is a diagram for describing an operation if a foreign matter is disposed in the process tray.

FIG. 6 is a diagram for describing the operation if a foreign matter is disposed in the process tray. A foreign matter F is permeated from the sheet discharging port 23*a* toward the stapler 55. For example, the foreign matter F is a child's hand. The foreign matter F is disposed along the upper surface of the process tray 51. The thickness in the Z direction of the foreign matter F becomes thin as it goes from the root portion to the tip end.

The first sensor 71 outputs the first signal corresponding to the first distance D1 to the object which is disposed at the first position P1. The object disposed at the first position P1 is the tip end of the foreign matter F. The first distance D1 is a distance from the first sensor 71 to the tip end of the foreign matter F. The first sensor 71 outputs the first signal corresponding to the first distance D1 to the image forming control unit 16.

The second sensor 72 outputs the second signal corresponding to the second distance D2 to the object which is disposed at the second position P2. The object disposed at the second position P2 is the root portion of the foreign matter F. The second distance D2 is a distance from the second sensor 72 to the root portion of the foreign matter F. The second sensor 72 outputs the second signal corresponding to the second distance D2 to the image forming control unit 16.

The image forming control unit 16 controls the stapling using the first signal and the second signal. The image forming control unit 16 compares the first distance D1 calculated from the first signal and the second distance D2 calculated from the second signal. The first distance D1 is greater than the second distance D2 if the foreign matter F is disposed in the process tray 51. The image forming control unit 16 determines that the foreign matter F is disposed in the process tray 51 if the first distance D1 and the second distance D2 are different. Specifically, the image forming control unit 16 determines that the foreign matter F is disposed in the process tray 51 if the difference between the first distance D1 and the second distance D2 is equal to or more than a predetermined value. At this time, the image forming control unit 16 stops the stapling. Specifically, the image forming control unit 16 outputs a stop signal of the stapling to the stapler 55. With this configuration, the stapling to the foreign matter F is avoided.

Further, the foreign matter F may be permeated in a state where the tip end of the foreign matter F floats in the Z direction from the upper surface of the process tray 51. In this case, the first distance D1 and the second distance D2 may be equal. However, the stapler 55 is disposed near the upper surface of the process tray 51 in the Z direction. Therefore, even when the stapling is performed, the stapling is not performed on the permeated foreign matter F. With this configuration, the stapling to the foreign matter F is avoided.

The control method of the sheet processing device will be described in detail.

Figure 7:
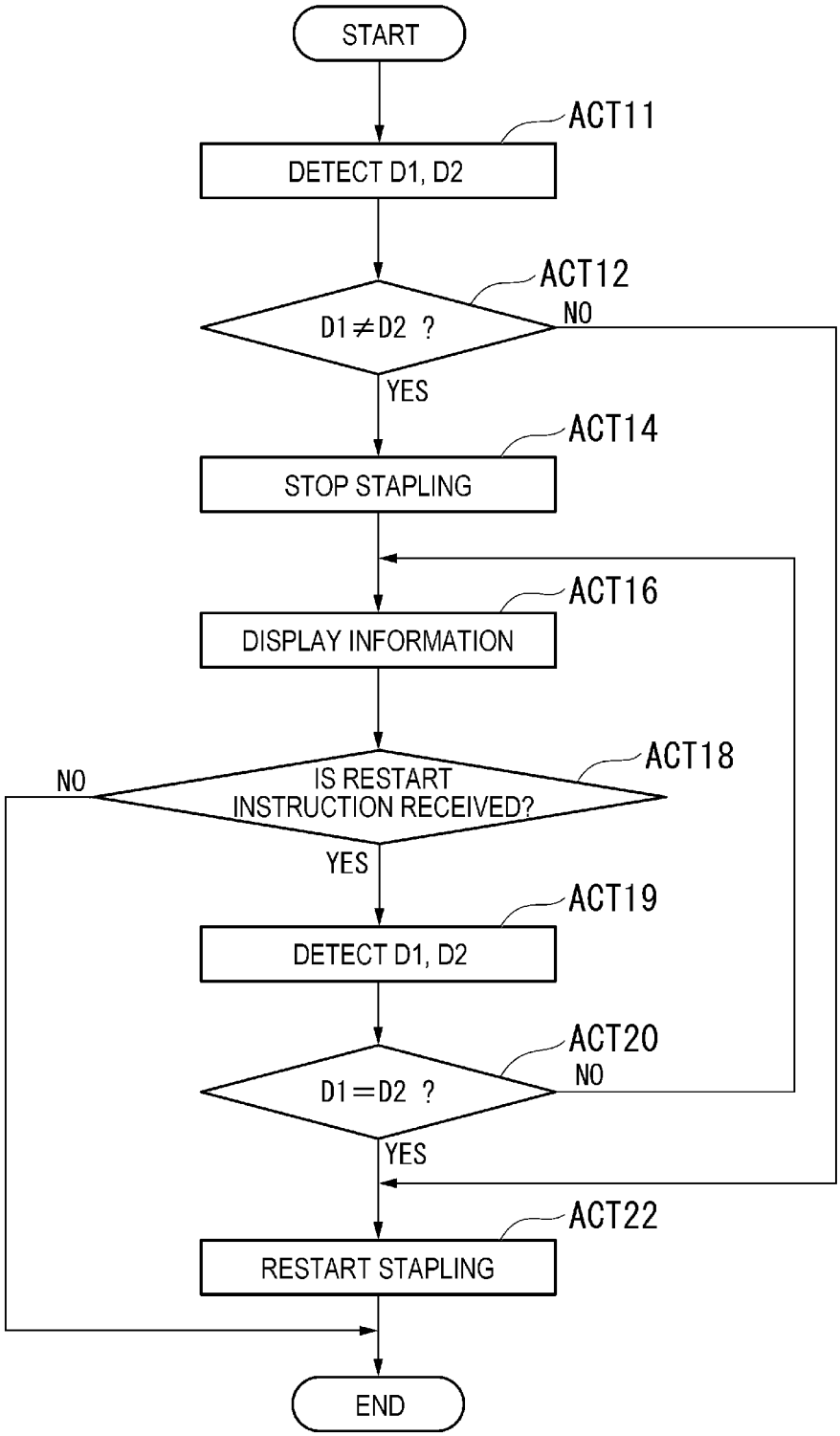
FIG. 7 is a flowchart of a control method of the sheet processing device.

FIG. 7 is a flowchart of the control method of the sheet processing device. The image forming control unit 16 controls the stapling using the first signal and the second signal immediately before the stapling. For example, a timing immediately before the stapling is a timing after a predetermined number of sheets S to be stapled is supplied from the standby tray 41 to the process tray 51.

The image forming control unit 16 receives the first signal and the second signal immediately before the stapling. The image forming control unit 16 detects the first distance D1 from the received first signal (ACT 11, first detection step). The image forming control unit 16 detects the second distance D2 from the received second signal (ACT 11, second detection step). The image forming control unit 16 compares the first distance D1 calculated from the first signal and the second distance D2 calculated from the second signal. The image forming control unit 16 determines whether the first distance D1 and the second distance D2 are different (ACT 12). If the determination of ACT 12 is "No", the first distance D1 and the second distance D2 are equal. In this case, the image forming control unit 16 determines that the sheet S is disposed in the process tray 51. The image forming control unit 16 performs the stapling (ACT 22, stapling control step).

As described above, the image forming control unit 16 performs the determination of ACT 12 immediately before the stapling. If the foreign matter F is permeated to the process tray 51, the foreign matter F is disposed on the sheet S, or the sheet S is disposed on the foreign matter F. In either case, the first distance D1 is greater than the second distance D2. Then, if the determination of ACT 12 is "Yes", the image forming control unit 16 determines that the foreign matter F is disposed in the process tray 51. The image forming control unit 16 stops the stapling (ACT 14, stapling control step). With this configuration, the stapling to the foreign matter F is avoided. In addition, the image forming control unit 16 stops the operation of the image forming device 2. With this configuration, it is suppressed that the sheet is jammed due to the permeation of the foreign matter F.

The image forming control unit 16 displays information on the control panel 11 (see FIG. 1) (ACT 16).

Figure 8:
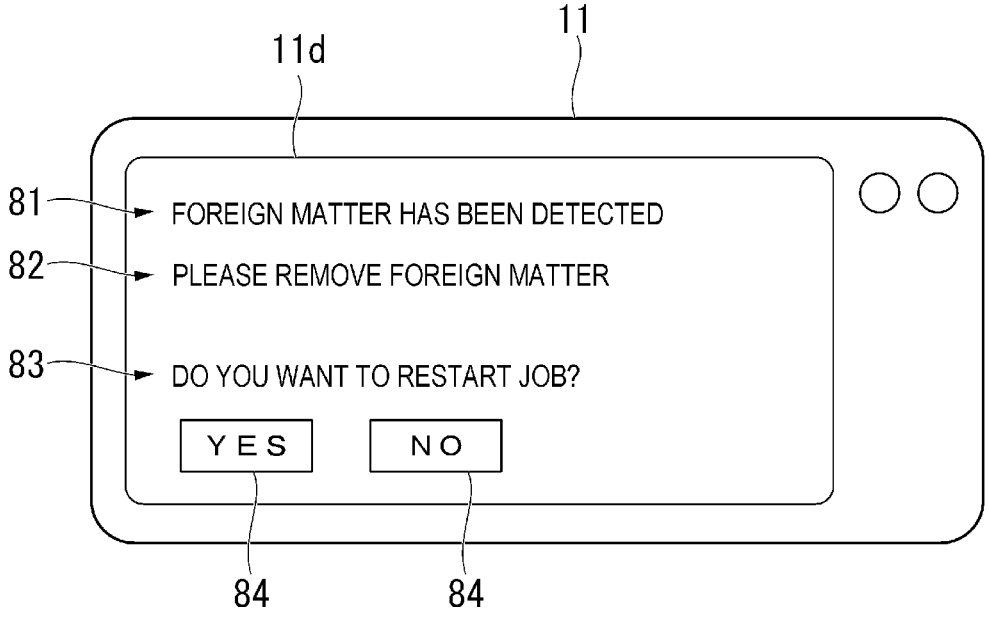
FIG. 8 is a diagram for describing an example of information display.

FIG. 8 is a diagram for describing an example of displaying information. The image forming control unit 16 displays information 81 related to the reason of abnormal operation (stopping the stapling) on a display unit 11*d* of the control panel 11. For example, the image forming control unit 16 displays "A foreign matter is detected" as information 81 related to the reason. The image forming control unit 16 displays information 82 related to a release method of the reason of the abnormal operation. For example, the image forming control unit 16 displays "Take off the foreign matter" as information 82 related to the release method.

The image forming control unit 16 displays information 83 which is used to restart the normal operation (stapling). For example, "Do you want to restart the job?" is displayed as information 83 which is used to restart. The image forming control unit 16 receives a user's instruction related to the restarting of the normal operation. For example, the image forming control unit 16 displays a button 84 of "YES" and a button 85 of "NO" following to information 83 which is used to restart. The display unit 11*d* includes the touch panel. When the user presses the button 84 of "YES", a user's instruction to restart the normal operation is input. When the user presses the button 85 of "NO", a user's instruction to stop the normal operation is input. The user's instruction is transmitted to the image forming control unit 16.

The image forming control unit 16 restarts the stapling when the restart instruction of the stapling is received after the stapling is stopped using the first signal and the second signal. The image forming control unit 16 determines whether the restart instruction of the stapling is received (ACT 18). If the stop instruction of the stapling is received, the determination of ACT 18 is "No". In this case, the image forming control unit 16 ends without restarting the stapling. If the restart instruction of the stapling is received, the determination of ACT 18 is "Yes", and the procedure proceeds to ACT 20.

The image forming control unit 16 restarts the stapling using the first signal and the second signal after the restart instruction of the stapling is received. The image forming control unit 16 receives the first signal and the second signal. The image forming control unit 16 detects the first distance D1 from the received first signal (ACT 19, first detection step). The image forming control unit 16 detects the second distance D2 from the received second signal (ACT 19, second detection step). The image forming control unit 16 compares the first distance D1 calculated from the first signal and the second distance D2 calculated from the second signal. The image forming control unit 16 determines whether the first distance D1 and the second distance D2 are equal (ACT 20). If the determination of ACT 20 is "No", the image forming control unit 16 determines that the foreign matter F is disposed in the process tray 51. In other words, the image forming control unit 16 determines that the foreign matter F is not taken off from the process tray 51. In this case, the image forming control unit 16 repeatedly performs the following information displaying (ACT 16) to the control panel 11.

As described above, if the foreign matter F is permeated to the process tray 51, the foreign matter F is disposed on the sheet S, or the sheet S is disposed on the foreign matter F. When the foreign matter F is taken off from the process tray 51, only the sheet S is left in the upper surface of the process tray 51. At this time, the first distance D1 and the second distance D2 are equal. Then, if the determination of ACT 20 is "Yes", the image forming control unit 16 determines that the foreign matter F is taken off from the process tray 51. The image forming control unit 16 restarts the stapling (ACT 22, stapling control step). With this configuration, the stapling is performed on the sheet S.

The image forming control unit 16 starts the operation of the image forming device 2 using the first signal and the second signal. The image forming control unit 16 performs the determination of ACT 20 using the first signal and the second signal, and restarts the stapling. Therefore, the image forming control unit 16 restarts the operation of the stopped image forming device 2. The image forming control unit 16 may use the first signal and the second signal not only when the operation of the image forming device 2 restarts but also when the operation of the image forming device 2 is started.

Therefore, the process of the control method of the sheet processing device ends.

As described above, the image forming system 1 of the embodiment includes the image forming device 2, the stapler 55, the process tray 51, the first sensor 71, the second sensor 72, and the image forming control unit 16. The image forming device 2 forms an image on the sheet S. The stapler 55 performs the stapling on the sheet S. The process tray 51 places the sheet S to be stapled on the upper surface. The first sensor 71 is disposed on the upper side of the process tray 51. The first sensor 71 outputs the first signal corresponding to the first distance D1 to the object disposed at the first position P1 of the sheet placement region 51*a* of the upper surface of the process tray 51 or the first thickness of the object which is disposed at the first position P1. The second sensor 72 is disposed on the upper side of the process tray 51. The second sensor 72 outputs the second signal corresponding to the second distance D2 to the object disposed at the second position P2 on the downstream side in the sheet discharge direction from the first position P1 of the sheet placement region 51*a* of the upper surface of the process tray 51 or the second thickness of the object which is disposed at the second position P2. The image forming control unit 16 is provided in the image forming device 2. The image forming control unit 16 controls the stapling using the first signal and the second signal.

Using the first signal and the second signal, a case where the sheet S is disposed in the process tray 51 and a case where the foreign matter F is disposed in the process tray 51 are distinguished. The image forming control unit 16 performs the stapling if the sheet S is disposed in the process tray 51. The image forming control unit 16 stops the stapling if the foreign matter F is disposed in the process tray 51. With this configuration, the stapling for the foreign matter F is suppressed.

The first sensor 71 is disposed on the upper side in the vertical direction of the first position P1 with respect to the upper surface of the process tray 51. The second sensor 72 is disposed on the upper side in the vertical direction of the second position P2 with respect to the upper surface of the process tray 51. The first sensor 71 and the second sensor 72 are disposed at the same height from the upper surface of the process tray.

The image forming control unit 16 stops the stapling if the first signal and the second signal are different. The first sensor 71 outputs the first signal corresponding to the first distance D1. The second sensor 72 outputs the second signal corresponding to the second distance D2. The image forming control unit 16 stops stapling if the first distance D1 indicated by the first signal and the second distance D2 indicated by the second signal are different.

With this configuration, if the sheet S is disposed in the process tray 51, the first signal (the first distance D1) and the second signal (the second distance D2) are equal. If the foreign matter F is disposed in the process tray 51, the first signal (the first distance D1) and the second signal (the second distance D2) are different. Therefore, the sheet S and the foreign matter F are easily discriminated, and the stapling for the foreign matter F is suppressed.

The first sensor 71 is formed to be movable in the Y direction intersecting the X direction together with the stapler 55. The second sensor 72 includes the plurality of second distribution sensors 72*a*, 72*b*, 72*c*, and 72*d* which are arranged along the Y direction intersecting the X direction.

The stapler 55 staples at the plurality of predetermined staple positions SP in the Y direction. According to the above configuration, the first sensor 71 and the second sensor 72 are disposed at the staple position SP where the stapler 55 staples. Therefore, the sheet S and the foreign matter F are discriminated at the staple position SP where the stapler 55 staples.

Since the first sensor 71 is formed to be movable together with the stapler 55, the plurality of first sensors 71 are not needed to be disposed. Since the first sensor 71 is disposed near the stapler 55, the first sensor 71 is easily formed to be movable together with the stapler 55. On the other hand, the second sensor 72 is disposed to be separated from the stapler 55. Since the second sensor 72 includes the plurality of second distribution sensors 72*a*, 72*b*, 72*c*, and 72*d*, there is no need to form the second sensor 72 to be movable together with the stapler 55.

The image forming control unit 16 controls the stapling using the first signal and the second signal immediately before the stapling.

With this configuration, an unnecessary stopping of the stapling is suppressed.

After the stapling is stopped using the first signal and the second signal, the image forming control unit 16 restarts the stapling after the restart instruction of the stapling is received.

The image forming control unit 16 stops the stapling when the foreign matter F is detected using the first signal and the second signal. The restarting of the stapling is instructed after the foreign matter F is taken off. The stapling for the foreign matter F is suppressed by restarting the stapling after the restart instruction is received.

The image forming control unit 16 restarts the stapling using the first signal and the second signal after the restart instruction of the stapling is received.

There is a possibility to instruct the restarting of the stapling before the foreign matter F is taken off. The image forming control unit 16 restarts the stapling if the foreign matter F is not detected using the first signal and the second signal. With this configuration, the stapling for the foreign matter F is suppressed.

The sheet processing device 3 of the embodiment includes the stapler 55, the process tray 51, the first sensor 71, and the second sensor 72. The stapler 55 performs the stapling on the sheet S. The process tray 51 places the sheet S to be stapled on the upper surface. The first sensor 71 is disposed on the upper side of the process tray 51. The first sensor 71 outputs the first signal corresponding to the first distance D1 to the object disposed at the first position P1 of the sheet placement region 51*a* of the upper surface of the process tray 51 or the first thickness of the object which is disposed at the first position P1. The second sensor 72 is disposed on the upper side of the process tray 51. The second sensor 72 outputs the second signal corresponding to the second distance D2 to the object disposed at the second position P2 on the downstream side in the sheet discharge direction from the first position P1 of the sheet placement region 51*a* of the upper surface of the process tray 51 or the second thickness of the object which is disposed at the second position P2. The sheet processing device 3 transmits the first signal and the second signal to the image forming device 2. The sheet processing device 3 operates on the basis of the content of the signal received from the image forming device 2.

With this configuration, the stapling for the foreign matter F is suppressed.

A control method of the sheet processing device of the embodiment includes the first detection step, the second detection step, and the stapling control step. In the first detection step, the first distance D1 or the first thickness are detected. The first distance D1 is a distance to the object which is disposed at the first position P1 of the sheet placement region 51*a* of the upper surface of the process tray 51. The first thickness is the thickness of the object which is disposed at the first position P1. The process tray 51 places the sheet S to be stapled. In the second detection step, the second distance D2 or the second thickness is detected. The second distance D2 is a distance to the object which is disposed at the second position P2 of the sheet placement region 51*a* of the upper surface of the process tray 51. The second thickness is the thickness of the object which is disposed at the second position P2. The second position P2 is a position on the downstream side in the sheet discharge direction from the first position P1. In the stapling control step, the stapling is controlled on the basis of the results of the first detection step and the second detection step.

With this configuration, the stapling for the foreign matter F is suppressed.

A sheet processing device of a first modification of the embodiment will be described.

Figure 9:
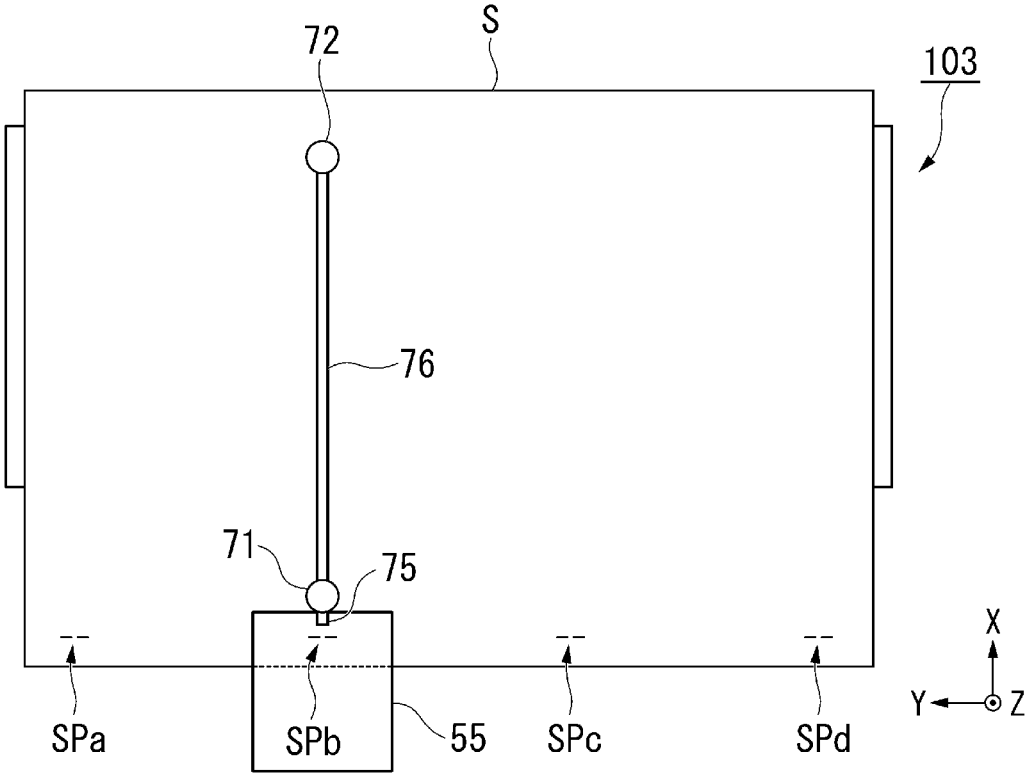
FIG. 9 is a top view schematically illustrating an exemplary configuration of a sheet processing device of a first modification of the embodiment.

FIG. 9 is a top view schematically illustrating an exemplary configuration of the sheet processing device of the first modification of the embodiment. A sheet processing device 103 of the first modification is different from the sheet processing device 3 of the embodiment in that the second sensor 72 is formed to be movable in the Y direction together with the stapler 55. The description of the similar portions in the sheet processing device 103 of the first modification as those in the sheet processing device 3 of the embodiment will be omitted.

The second sensor 72 is coupled to the first sensor 71 through a second coupling member 76. As described above, the first sensor 71 is coupled to the stapler 55 through the first coupling member 75. With this configuration, the second sensor 72 is formed to be movable in the Y direction together with the first sensor 71 and the stapler 55. The first sensor 71 and the second sensor 72 are movable to A position SPa, B position SPb, C position SPc, and D position SPd along the Y direction.

In this way, the second sensor 72 is formed to be movable in the Y direction intersecting the X direction together with the stapler 55. With this configuration, the plurality of second distribution sensors are not necessarily disposed. Therefore, the cost of the sheet processing device 103 is reduced.

A sheet processing device of a second modification of the embodiment will be described.

Figure 10:
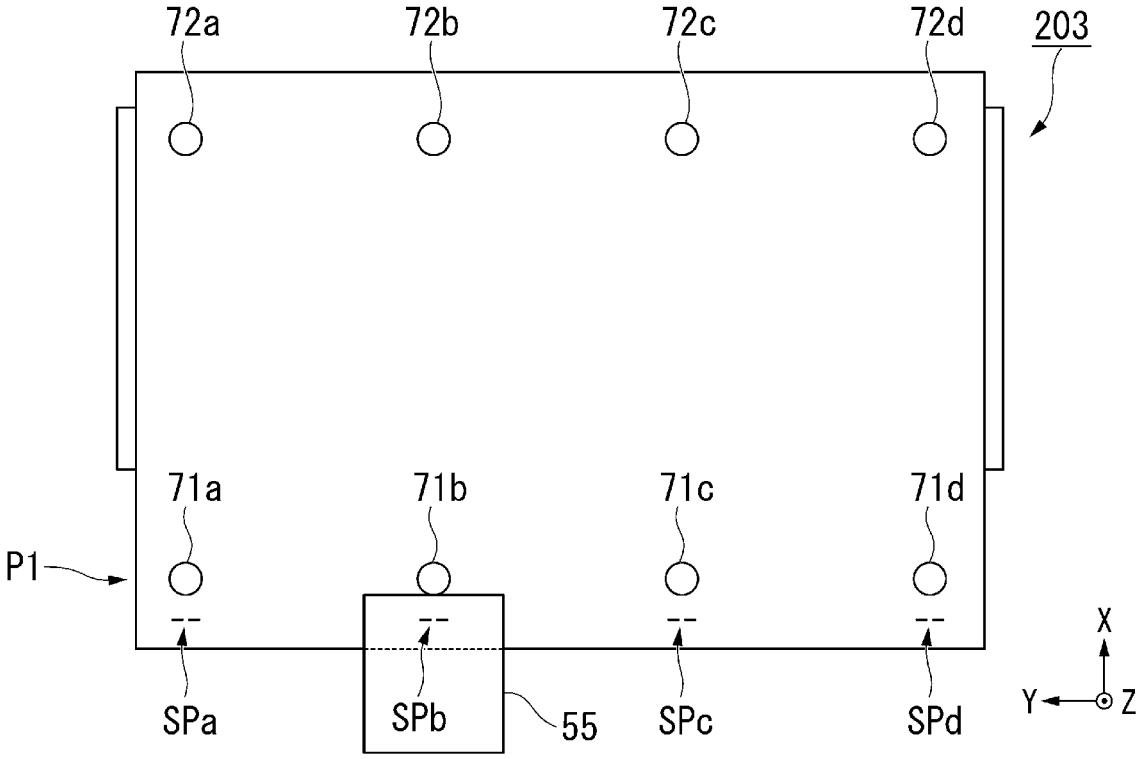
FIG. 10 is a top view schematically illustrating an exemplary configuration of a sheet processing device of a second modification of the embodiment.

FIG. 10 is a top view schematically illustrating an exemplary configuration of the sheet processing device of the second modification of the embodiment. A sheet processing device 203 of the second modification, is different from the sheet processing device 3 of the embodiment in that the first sensor 71 includes a plurality of first distribution sensors 71*a*, 71*b*, 71*c*, and 71*d*. The description of the same portions of the sheet processing device 203 of the second modification as those of the sheet processing device 3 of the embodiment will be omitted.

The first sensor 71 is configured by the plurality of first distribution sensors 71*a*, 71*b*, 71*c*, and 71*d*. The plurality of first distribution sensors 71*a*, 71*b*, 71*c*, and 71*d* are disposed at the first position P1 in the X direction. The plurality of first distribution sensors 71*a*, 71*b*, 71*c*, and 71*d* are disposed in correspondence with the plurality of staple positions SPa, SPb, SPc, and SPd in the Y direction. In other words, the first A distribution sensor 71*a* is disposed at A position SPa in the Y direction. The first B distribution sensor 71*b* is disposed at B position SPb in the Y direction. The first C distribution sensor 71*c* is disposed at C position SPc in the Y direction. The first D distribution sensor 71*d* is disposed at D position SPd in the Y direction.

In this way, the first sensor 71 includes the plurality of first distribution sensors 71*a*, 71*b*, 71*c*, and 71*d* which are disposed along the Y direction intersecting the X direction. With this configuration, the first sensor 71 does not move in the Y direction, so that interference between the first sensor 71 and the components of the sheet processing device 3 is avoided.

In the above-described embodiment, the first sensor 71 and the second sensor 72 are disposed at the same height from the upper surface of the process tray 51. With this regard, the first sensor 71 and the second sensor 72 may be disposed at different heights from the upper surface of the process tray 51. At this time, the image forming control unit 16 compares the first distance D1 and the second distance D2 in consideration of the difference in height between the first sensor 71 and the second sensor 72.

In the above-described embodiment, the first sensor 71 is disposed on the upper side in the vertical direction of the first position P1 with respect to the upper surface of the process tray. In other words, a straight line connecting the first sensor 71 and the first position P1 is disposed to be perpendicular to the upper surface of the process tray. With this regard, the straight line connecting the first sensor 71 and the first position P1 may be disposed to be inclined to the upper surface of the process tray. At this time, the image forming control unit 16 compares the first distance D1 and the second distance D2 in consideration with an inclined angle and an inclined direction of the straight line connecting the first sensor 71 and the first position P1.

The configuration of the second sensor 72 is also similar.

In the above-described embodiment, the image forming control unit 16 compares the first distance D1 calculated from the first signal and the second distance D2 calculated from the second signal to control the stapling. With this regard, the image forming control unit 16 may compare another value calculated from the first signal and another value calculated from the second signal. In addition, the image forming control unit 16 may compare the first signal itself and the second signal itself.

In the above-described embodiment, the first sensor 71 and the second sensor 72 output the first signal and the second signal to the image forming control unit 16. With this regard, the first sensor 71 and the second sensor 72 may output the first signal and the second signal to the post-processing control unit 25. In this case, the post-processing control unit 25 transmits the first signal and the second signal to the image forming control unit 16. In addition, the post-processing control unit 25 may control the stapling by itself using the first signal and the second signal.

In the above-described embodiment, the image forming control unit 16 controls the stapling. With this regard, the image forming control unit 16 may control the stapling through the post-processing control unit 25.

In the above-described embodiment, the plurality of second distribution sensors 72*a*, 72*b*, 72*c*, and 72*d* are disposed in correspondence with the plurality of staple positions SPa, SPb, SPc, and SPd. At this time, the distance to the object existing at one staple position SP is detected by one second sensor 72. With this regard, the distance to the object existing at the plurality of staple positions SP may be detected by one second sensor 72.

According to at least one of the embodiments described above, the first sensor 71, the second sensor 72, and the image forming control unit 16 are provided. The first sensor 71 outputs the first signal corresponding to the first distance D1 to the object which is disposed at the first position P1 of the sheet placement region 51*a* of the upper surface of the process tray 51. The second sensor 72 outputs the second signal corresponding to the second distance D2 to the object which is disposed at the second position P2 on the downstream side in the sheet discharge direction from the first position P1 of the sheet placement region 51*a* of the upper surface of the process tray 51. The image forming control unit 16 controls the stapling using the first signal and the second signal. With this configuration, it is possible to suppress the stapling for the foreign matter F.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. An image forming system, comprising:

an image forming device configured to form an image on a sheet;

a stapler configured to staple the sheet;

a process tray positioned on an upper surface of the sheet to be stapled;

a first sensor disposed on an upper side of the process tray, and configured to output a first signal corresponding to a first distance to an object disposed at a first position of a sheet placement region of an upper surface of the process tray, or a first thickness of the object disposed at the first position;

a second sensor disposed on the upper side of the process tray, and configured to output a second signal corresponding to a second distance to the object disposed at a second position on a downstream side in a sheet discharge direction from the first position of the sheet placement region of the upper surface of the process tray, or a second thickness of the object disposed at the second position; and a control unit provided in the image forming device, and configured to control the stapling using the first signal and the second signal.

2. The system according to claim 1, wherein the first sensor is disposed on an upper side in a vertical direction of the first position with respect to the upper surface of the process tray, the second sensor is disposed on an upper side in the vertical direction of the second position with respect to the upper surface of the process tray, and the first sensor and the second sensor are disposed at a same height from the upper surface of the process tray.

3. The system according to claim 2, wherein the control unit stops the stapling if the first signal and the second signal are different.

4. The system according to claim 2, wherein the first sensor outputs the first signal corresponding to the first distance, the second sensor outputs the second signal corresponding to the second distance, and the control unit stops the stapling if the first distance indicated by the first signal and the second distance indicated by the second signal are different.

5. The system according to claim 1, wherein the first sensor is movable in a direction intersecting the sheet discharge direction together with the stapler, and the second sensor comprises the plurality of second distribution sensors which are arranged along a direction intersecting the sheet discharge direction.

6. The system according to claim 1, wherein the first sensor comprises a plurality of first distribution sensors which are arranged along a direction intersecting the sheet discharge direction, and the second sensor comprises the plurality of second distribution sensors which are arranged along a direction intersecting the sheet discharge direction.

7. The system according to claim 1, wherein the control unit restarts the stapling when receiving a restart instruction of stapling after the stapling is stopped using the first signal and the second signal.

8. The system according to claim 7, wherein the control unit restarts the stapling using the first signal and the second signal after receiving the restart instruction of the stapling.

9. A sheet processing device, comprising:

a stapler configured to staple a sheet;

a process tray positioned on an upper surface of the sheet to be stapled;

a first sensor disposed on an upper side of the process tray, and configured to output a first signal corresponding to a first distance to an object disposed at a first position of a sheet placement region of an upper surface of the process tray, or a first thickness of the object disposed at the first position; and a second sensor disposed on the upper side of the process tray, and configured to output a second signal corresponding to a second distance to the object disposed at a second position on a downstream side in a sheet discharge direction from the first position of the sheet placement region of the upper surface of the process tray, or a second thickness of the object disposed at the second position, wherein the first signal and the second signal are transmitted to an image forming device, and an operation is performed by the sheet processing device on the basis of a content received from the image forming device.

10. The device according to claim 9, wherein the first sensor is disposed on an upper side in a vertical direction of the first position with respect to the upper surface of the process tray, the second sensor is disposed on an upper side in the vertical direction of the second position with respect to the upper surface of the process tray, and the first sensor and the second sensor are disposed at a same height from the upper surface of the process tray.

11. The device according to claim 10, wherein the control unit stops the stapling if the first signal and the second signal are different.

12. The device according to claim 10, wherein the first sensor outputs the first signal corresponding to the first distance, the second sensor outputs the second signal corresponding to the second distance, and the control unit stops the stapling if the first distance indicated by the first signal and the second distance indicated by the second signal are different.

13. The device according to claim 9, wherein the first sensor is movable in a direction intersecting the sheet discharge direction together with the stapler, and the second sensor comprises the plurality of second distribution sensors which are arranged along a direction intersecting the sheet discharge direction.

14. The device according to claim 9, wherein the first sensor comprises a plurality of first distribution sensors which are arranged along a direction intersecting the sheet discharge direction, and the second sensor comprises the plurality of second distribution sensors which are arranged along a direction intersecting the sheet discharge direction.

15. The device according to claim 9, wherein the control unit restarts the stapling when receiving a restart instruction of stapling after the stapling is stopped using the first signal and the second signal.

16. The device according to claim 15, wherein the control unit restarts the stapling using the first signal and the second signal after receiving the restart instruction of the stapling.

17. A control method of a sheet processing device, the method comprising:

detecting a first distance to an object disposed at a first position of a sheet placement region of an upper surface of a process tray where a sheet to be stapled is placed, or a first thickness of the object disposed at the first position;

detecting a second distance to the object disposed at a second position on a downstream side in a sheet discharge direction from the first position of the sheet placement region of the upper surface of the process tray, or a second thickness of the object disposed at the second position; and controlling stapling the sheet on the basis of the detecting results of the first distance or the first thickness and the second distance or the second thickness.

18. The method according to claim 17, wherein detecting the first distance and detecting the second distance are performed at a same height from the upper surface of the process tray.

19. The system according to claim 17, further comprising:

stopping the stapling if the first signal and the second signal are different.

20. The method according to claim 19, further comprising:

restarting the stapling when receiving a restart instruction of stapling after the stapling is stopped using the first signal and the second signal.

* * * * *